US006883812B1

(12) United States Patent
Hsieh

(10) Patent No.: US 6,883,812 B1
(45) Date of Patent: Apr. 26, 2005

(54) SIZE ADJUSTABLE IN-LINE SKATES

(76) Inventor: Chao Hsieh, 8F, No. 310, Section 4, Jhongsiao E. Rd., Taipei City (TW)

( * ) Notice: Subject to any disclaimer, the term of this patent is extended or adjusted under 35 U.S.C. 154(b) by 11 days.

(21) Appl. No.: 10/695,984

(22) Filed: Oct. 30, 2003

(51) Int. Cl.[7] ..... A63C 17/04

(52) U.S. Cl. ..... 280/11.231; 280/11.221; 280/11.26; 280/11.16

(58) Field of Search ..... 280/11.221, 11.26, 280/11.16, 11.231, 11.223, 11.233, 11.25, 280/11.224, 11.232, 11.34; 39/97, 115

(56) References Cited

U.S. PATENT DOCUMENTS 5,484,149 A * 1/1996 Lee ..... 280/11.26
5,645,288 A * 7/1997 Lu ..... 280/11.26
5,794,362 A * 8/1998 Polk et al. ..... 36/97
5,836,592 A * 11/1998 Chang ..... 280/11.26
6,217,039 B1 * 4/2001 Iverson et al. ..... 280/11.26
6,308,965 B1 * 10/2001 Yang ..... 280/11.221
6,374,516 B1 * 4/2002 Bonaventure et al. ..... 36/115
6,422,579 B1 * 7/2002 Lindblad ..... 280/11.26
6,450,510 B1 * 9/2002 Liu ..... 280/11.26
6,497,420 B2 * 12/2002 Ricci ..... 280/11.16
6,547,261 B2 * 4/2003 Gorza et al. ..... 280/11.223
6,666,463 B2 * 12/2003 Svensson et al. ..... 280/11.231
6,669,210 B2 * 12/2003 Chen ..... 280/11.16

* cited by examiner

*Primary Examiner*—Christopher P. Ellis
*Assistant Examiner*—Hau Phan

(57) ABSTRACT

An in-line skate includes a sole plate having wheels rotatably connected to the underside of the sole plate and two elongated first slots are longitudinally defined through the sole plate. A rear portion of vamp is connected to a connection wall on the sole plate. A toe part has two elongated second slots longitudinally defined therethrough and a front portion of vamp is connected to the toe part. The toe part is connected to a top of a front end of the sole plate. Two adjusting members extend through the second slots in the top part and the first slots in the sole plate and are cooperated with two quick-release levers located at the underside of the sole plate such that the toe part can be moved relative to the sole plate by operation of the adjusting members.

5 Claims, 8 Drawing Sheets

SIZE ADJUSTABLE IN-LINE SKATES

FIELD OF THE INVENTION

The present invention relates to an in-line skate which is composed of two parts so as to be adjusted the size of the skate.

BACKGROUND OF THE INVENTION

A conventional in-line skate generally includes a vamp connected to a sole plate which is made of aluminum alloy or plastic material and several wheel frame are integrally connected to an underside of the sole plate so as to install wheels thereto. The size of the in-line skate is fixed and cannot be adjusted because the sole plate is a one-piece plate. This means each individual has to buy his or her in-line skates which fit his or her feet. Kids grow so fast such that the in-line skates have to be purchased and upgraded frequently.

The present invention intends to provide an in-line skate that is composed of a front portion and a rear portion, wherein the front portion can be movably positioned on the sole plate by at least two adjusting members employing quick-releases.

SUMMARY OF THE INVENTION

The present invention relates to an in-line skate which comprises a sole plate having wheel frames connected to an underside thereof and wheels are rotatably connected to the wheel frames. Two elongated first slots are longitudinally defined through the sole plate. A rear portion of vamp is connected to a connection wall on the sole plate and a toe part is movably connected to a front end of the sole plate. The toe plate has two elongated second slots longitudinally defined therethrough and a front portion of vamp is connected to the toe part. Two adjusting members extend through the second slots in the top part and the first slots in the sole plate.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
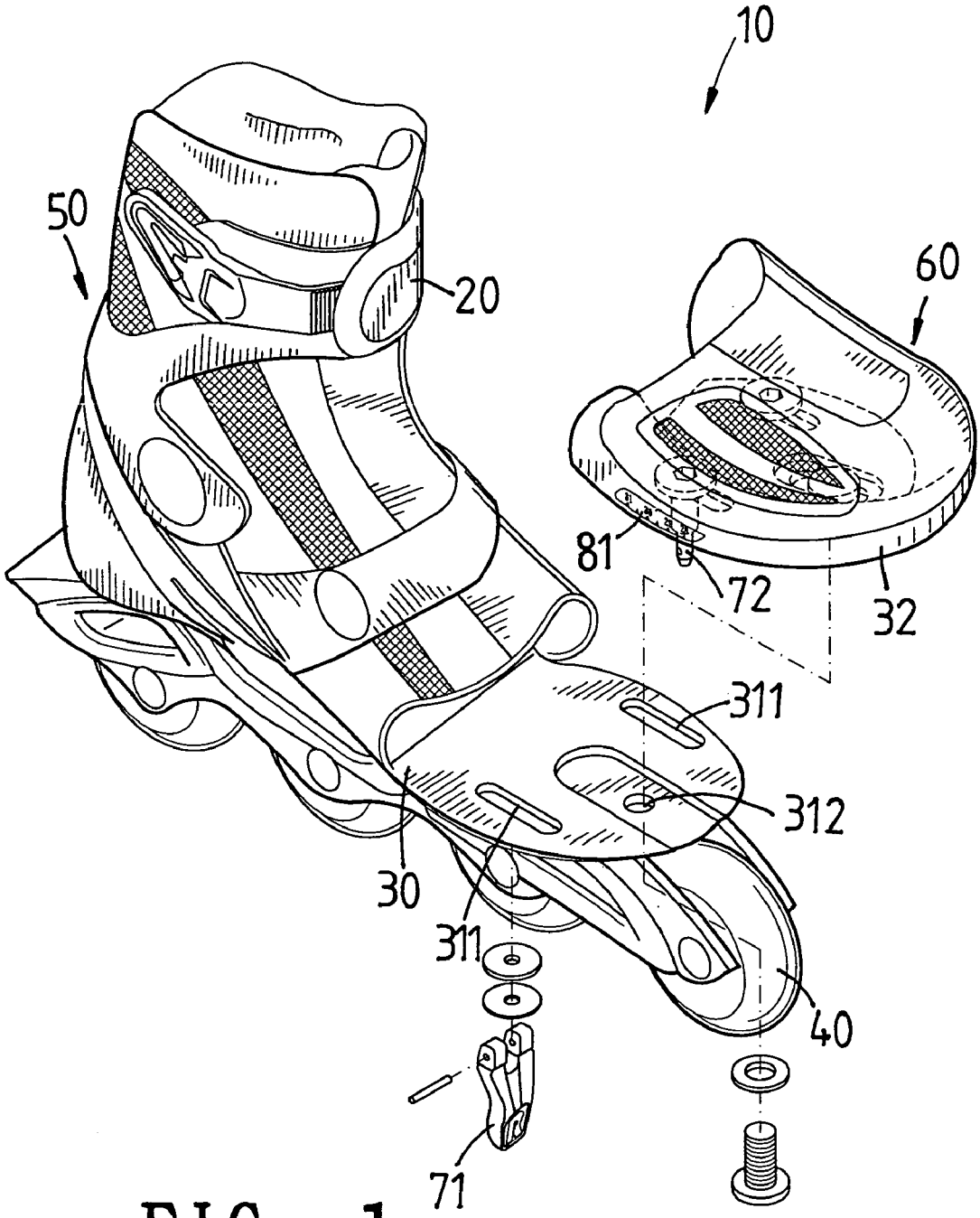
FIG. 1 is an exploded view to show the in-line skate of the present invention.
Figure 2:
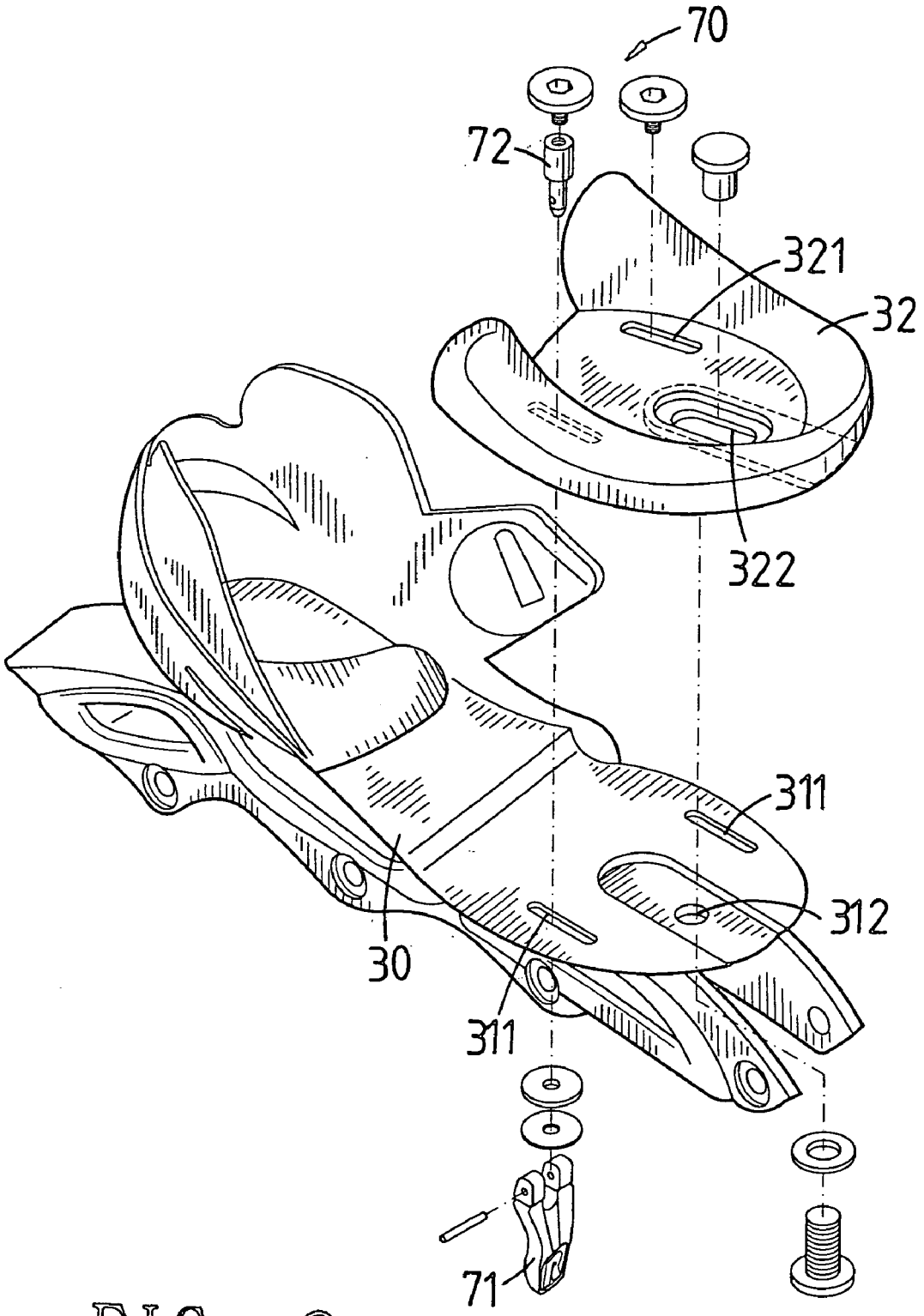
FIG. 2 is an exploded view to show the sole plate and the toe part of the in-line skate of the present invention.
Figure 3:
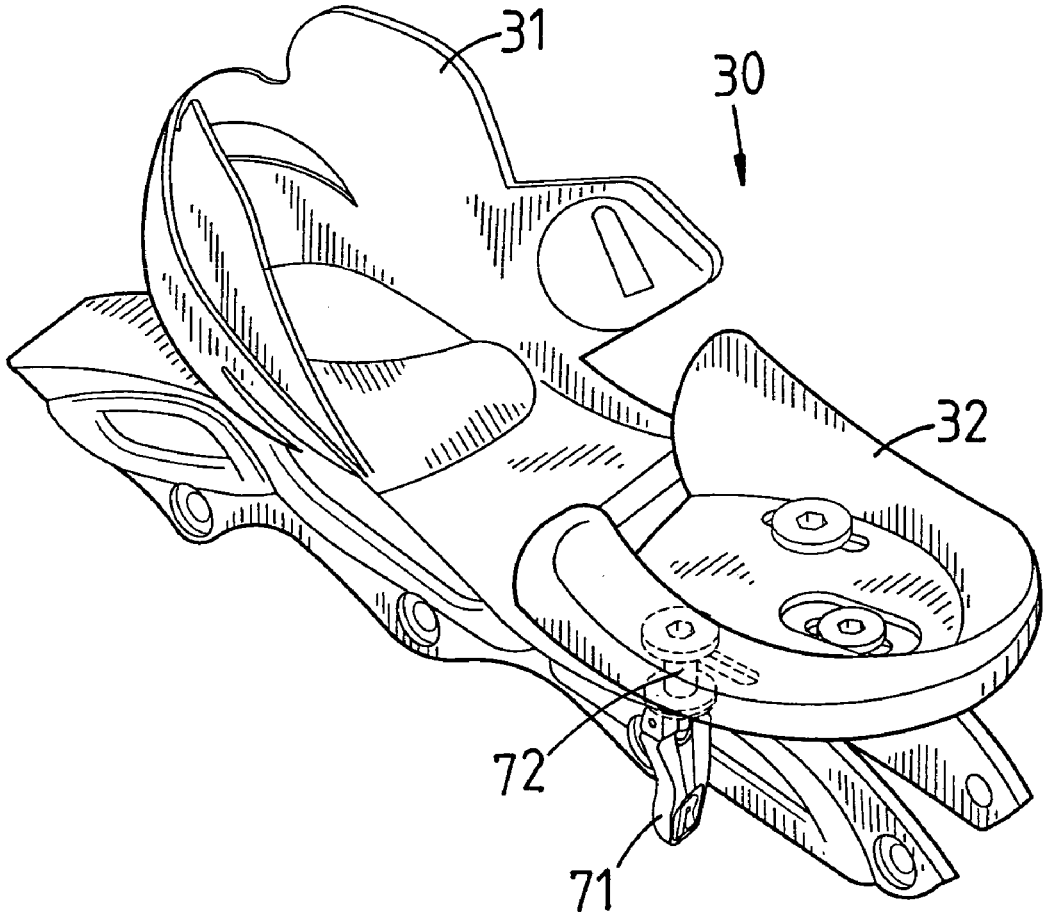
FIG. 3 is a perspective view to show the combination of the sole plate and the toe part of the in-line skate of the present invention.

Referring to FIGS. 1 to 3 and 8, the in-line skate 10 of the present invention comprises a sole plate 30 having wheel frames connected to an underside thereof and wheels 40 are rotatably connected to the wheel frames. Two elongated first slots 311 and a hole 312 are longitudinally defined through the sole plate 30. A rear portion of vamp 50 is connected to a connection wall 31 on the sole plate 30 and a tightening member 20 is connected to the rear portion of vamp 50.

A toe part 32 has two elongated second slots 321 and an engaging hole 322 are longitudinally defined therethrough and a front portion of vamp 60 is connected to the toe part 32. The toe part 32 is movably connected to a top of a front end of the sole plate 30 by two adjusting members 70 extending through the second slots 321 in the top part 32 and the first slots 311 in the sole plate 30, and a bolt extending through the engaging hole 312 of the sole plate 30 and the hole 322 in the toe part 32. Each adjusting member 70 includes a rod 72 and a quick-release lever 71 which has a cam head pivotably connected to a lower end of the rod 72. Each of the quick-release levers 71 is located at the underside of the sole plate 30.

Figure 4:
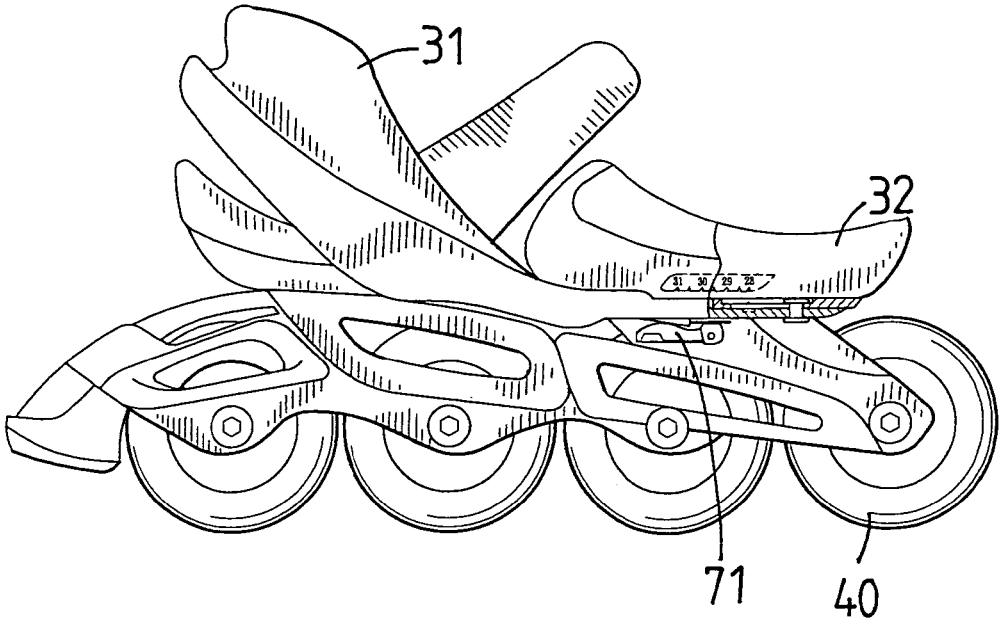
FIG. 4 is a side view to show the quick-release lever is in locked position.
Figure 5:
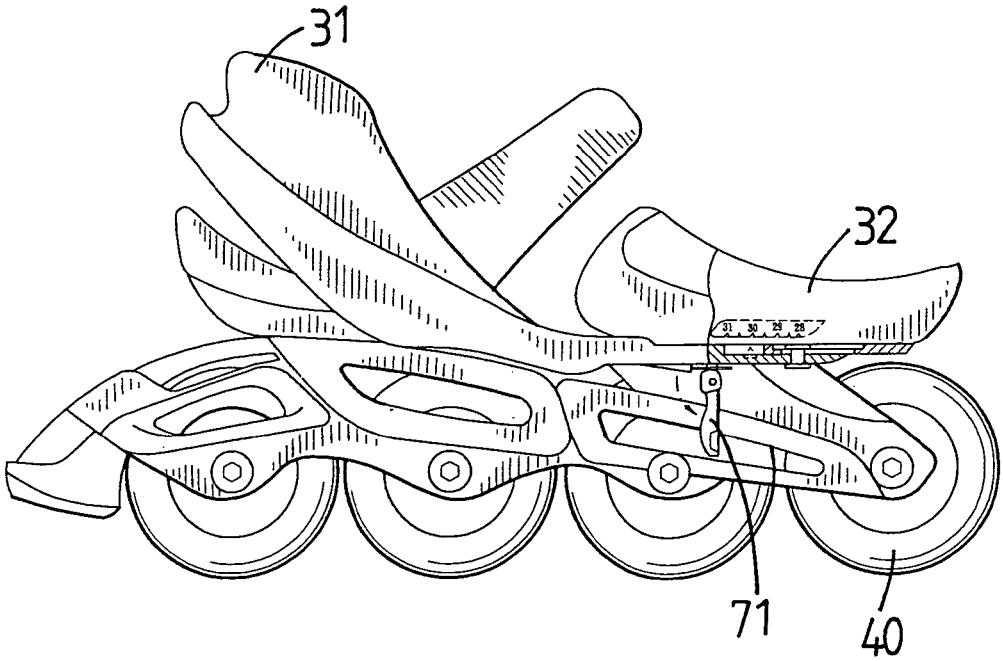
FIG. 5 is a side view to show the quick-release lever is in unlocked position.

As shown in FIG. 4, the quick-release levers 71 are located in horizontal position to securely connect the toe part 32 to the sole plate 30, and are pivoted to upright position as shown in FIG. 5 to release the rod 72. At the unlock position of the quick-release levers 71, the toe part 32 can be moved relative to the sole plate 30 along the first slots 321 so as to adjust the size of the in-line skate.

Figure 6:
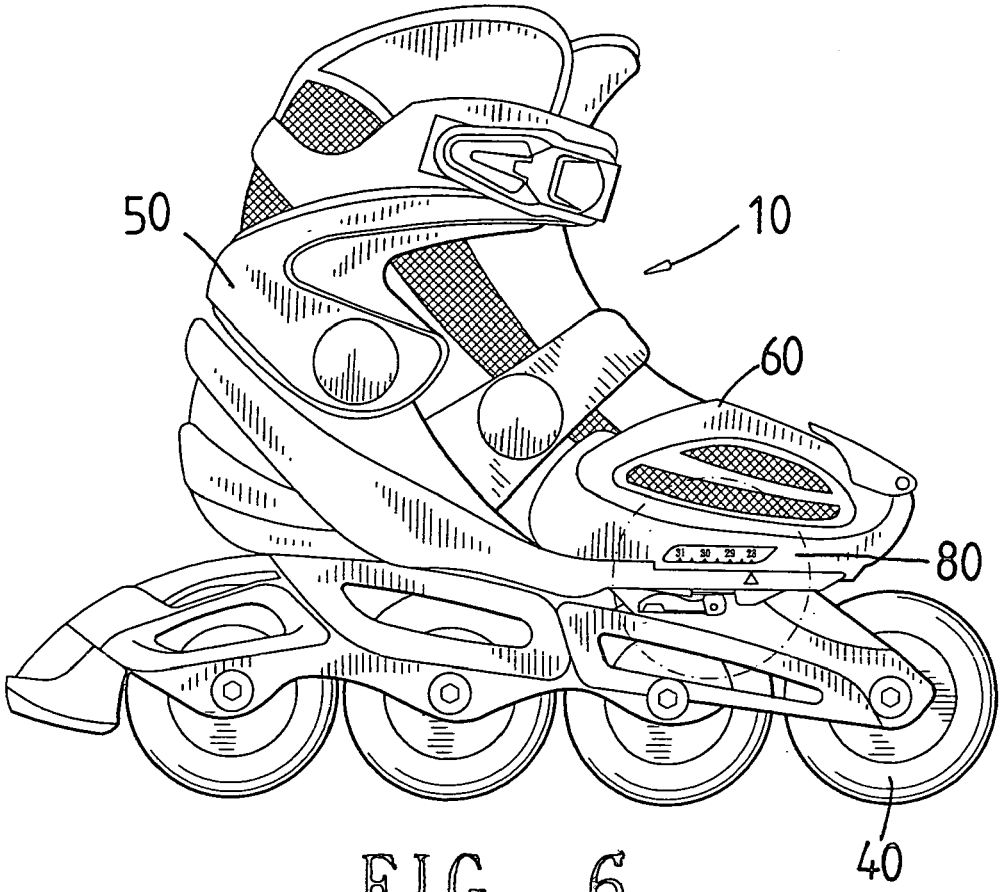
FIG. 6 shows a side view of the in-line skate of the present invention.
Figure 7:
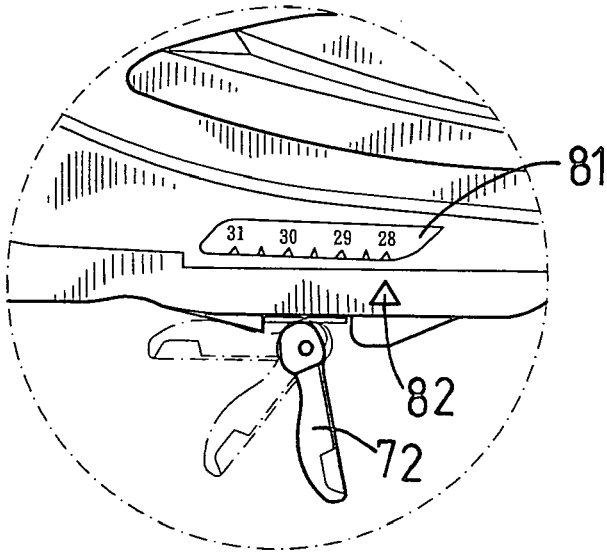
FIG. 7 is an enlarged view to show the indication mark and the size numbers on the in-line skate of the present invention.
Figure 8:
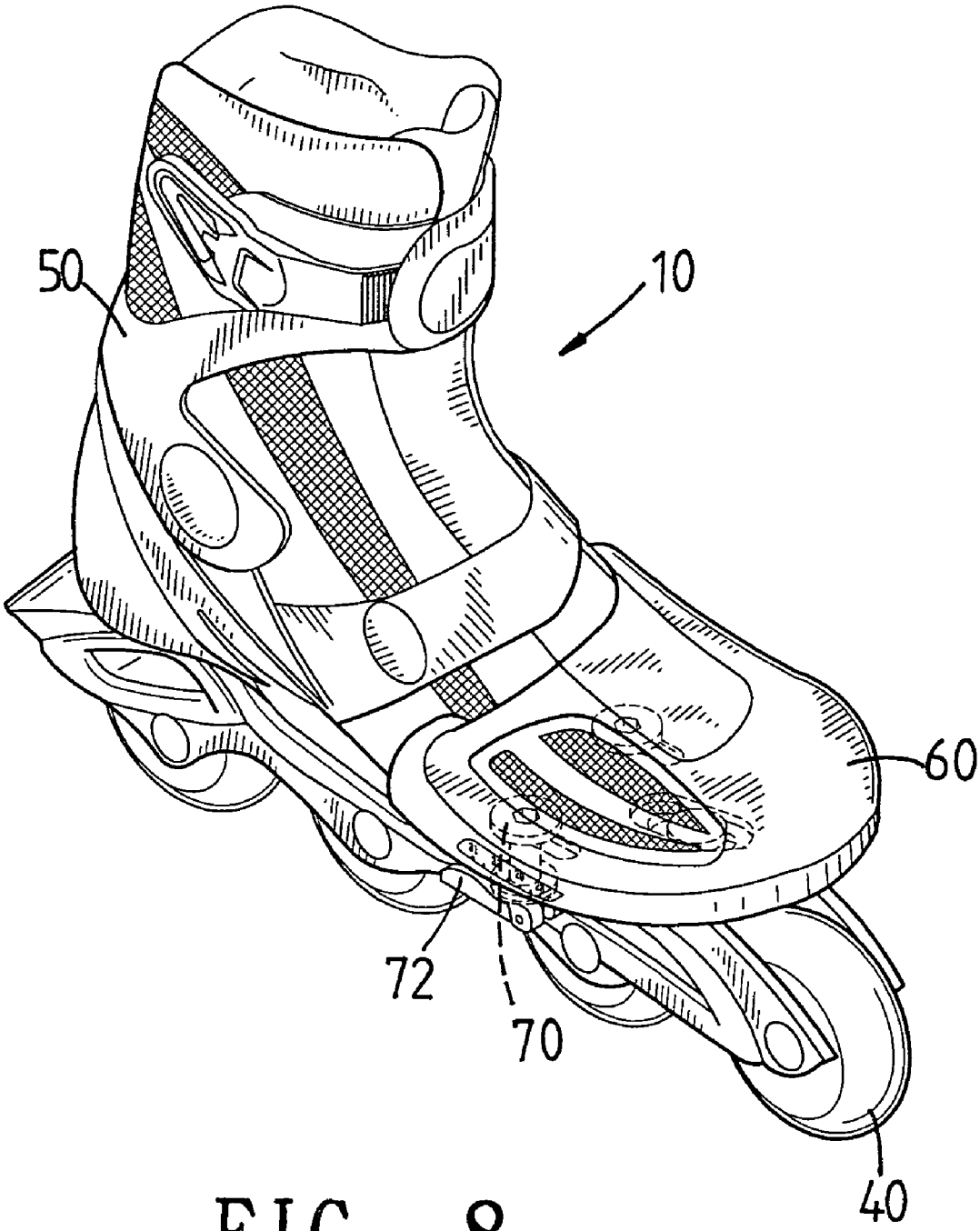
FIG. 8 is a perspective view to show the in-line skate of the present invention.

As shown in FIGS. 6 and 7, a triangle-shaped indication mark 82 is marked on a side of the sole plate 30 and the top part 32 has size numbers 81 on an outer periphery thereof. The indication mark 82 is pointed at one of the size numbers 81 when adjusting the toe part 32.

Figure 9:
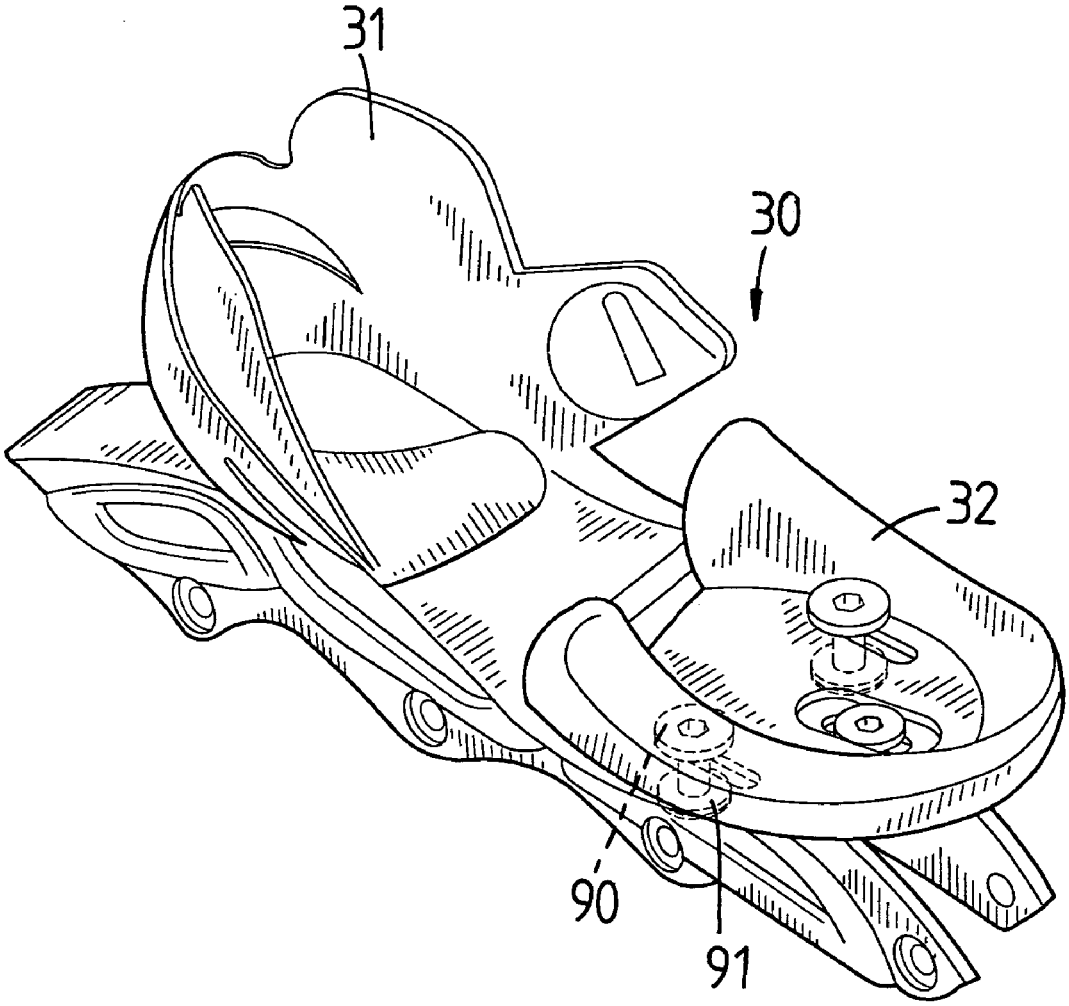
FIG. 9 is a perspective view to show the in-line skate with another embodiment of the adjusting members.
Figure 10:
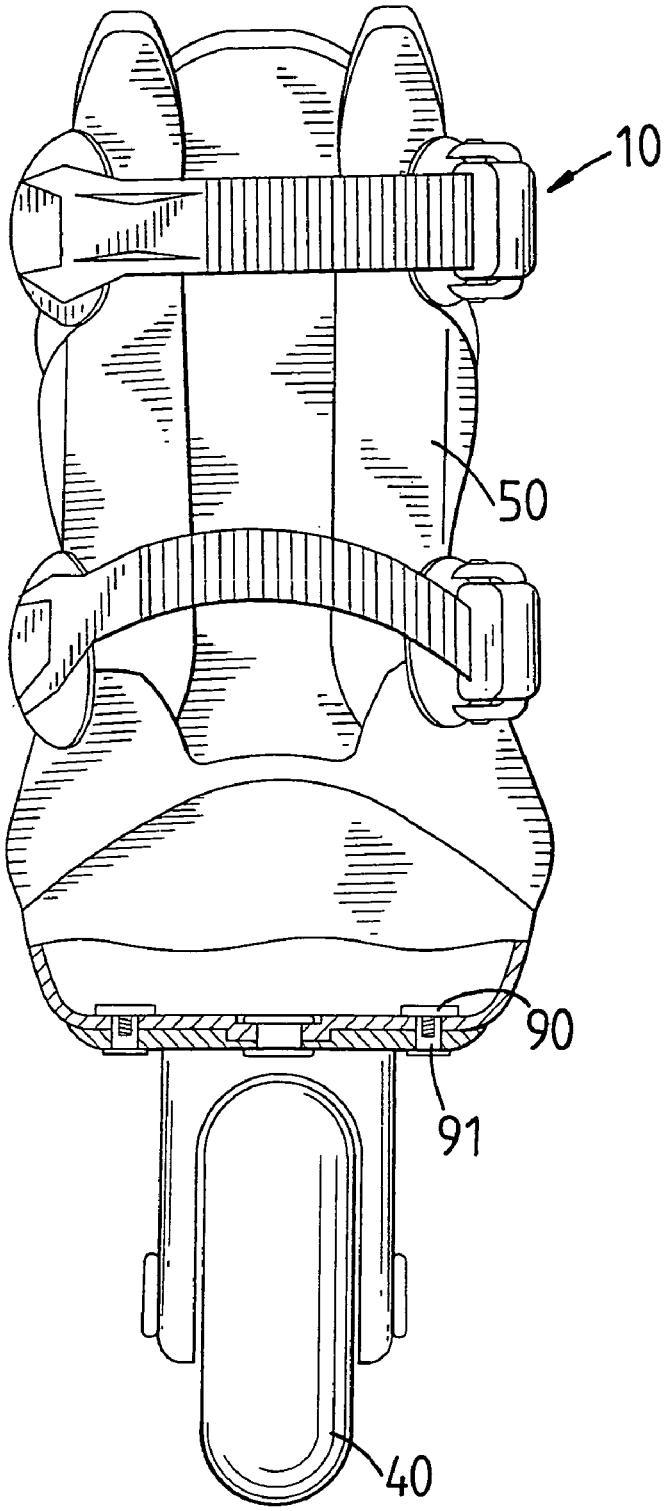
FIG. 10 is a front cross sectional view of the in-line skate of the present invention as shown in FIG. 9.

As shown in FIGS. 9 to 10, the adjusting members can be a bolts 90 which is connected to a nut 91 which is located at the underside of the sole plate 30.

While we have shown and described the embodiment in accordance with the present invention, it should be clear to those skilled in the art that further embodiments may be made without departing from the scope of the present invention.

What is claimed is:

1. An in-line skate comprising:

a sole plate having wheel frames connected to an underside thereof and wheels rotatably connected to the wheel frames, two elongated first slots longitudinally defined through the sole plate;

a rear portion of vamp connected to a connection wall on the sole plate;

a toe part having two elongated second slots longitudinally defined therethrough and a front portion of vamp connected to the toe part, the toe part connected to a top of a front end of the sole plate, and two adjusting members extending through the second slots in the top part and the first slots in the sole plate.

2. The in-line skate as claimed in claim 1, wherein each adjusting member includes a rod and a quick-release lever is pivotably connected to a lower end of the rod, each of the quick-release levers having a cam head which is pivotably connected to the rod.

3. The in-line skate as claimed in claim 2, wherein the quick-release levers are located at the underside of the sole plate.

4. The in-line skate as claimed in claim 1, wherein an indication mark is marked on a side of the sole plate and the top part has size numbers on an outer periphery thereof, the indication mark pointed at one of the size numbers.

5. The in-line skate as claimed in claim 1, wherein each of the adjusting members includes a bolt which is connected to a nut which is located at the underside of the sole plate.

* * * * *